US006966079B2

(12) United States Patent
Stetson

(10) Patent No.: US 6,966,079 B2
(45) Date of Patent: Nov. 22, 2005

(54) POOL SKIMMER

(76) Inventor: Michael A. Stetson, 32535 Branbel Ct., Lake Elsinore, CA (US) 92532

( * ) Notice: Subject to any disclaimer, the term of this patent is extended or adjusted under 35 U.S.C. 154(b) by 0 days.

(21) Appl. No.: 10/612,745

(22) Filed: Jul. 2, 2003

(65) Prior Publication Data

US 2005/0000012 A1 Jan. 6, 2005

(51) Int. Cl.[7] ..... E04H 4/00
(52) U.S. Cl. ..... 4/508; 4/509; 4/512; 4/513; 4/506
(58) Field of Search ..... 4/506–510, 512, 4/513, 488, 496; 210/169; 137/624.14

(56) References Cited

U.S. PATENT DOCUMENTS 2,826,307 A * 3/1958 Pace ..... 210/169
2,900,079 A * 8/1959 Pace ..... 210/169
3,616,468 A * 11/1971 Takacs ..... 4/509
3,910,840 A * 10/1975 Adam ..... 210/169
4,212,740 A 7/1980 Greene
4,225,436 A 9/1980 Cseh
4,454,035 A 6/1984 Stefan
4,818,389 A 4/1989 Tobias et al.
4,839,050 A 6/1989 Beard et al.
5,336,400 A 8/1994 Patrice
5,581,826 A 12/1996 Edwards
5,888,386 A 3/1999 Enright
6,158,064 A * 12/2000 Downs ..... 4/508
6,214,217 B1 4/2001 Sliger, Jr.
6,383,374 B1 5/2002 Splendorio
6,592,756 B1 7/2003 Felix, Jr. et al.

* cited by examiner

*Primary Examiner*—Khoa D. Huynh
(74) *Attorney, Agent, or Firm*—Stetina Brunda Garred & Brucker

(57) ABSTRACT

A skimmer system is provided which includes a reservoir, an inlet, a reservoir pump and a weir. The skimmer system is attached to a tank having fluid therein. The fluid in the tank defines a tank fluid surface. The reservoir receives fluid from the tank. The fluid in the reservoir defines a reservoir fluid surface. The level of the reservoir fluid surface is maintained below the level of the tank fluid surface when the skimmer system is turned on. The inlet defines an inlet edge and an inlet surface. The inlet edge is located below the level of the tank fluid surface. The inlet surface declines away from the tank to transfer the fluid from the tank to the reservoir. The reservoir pump transfers fluid from the reservoir to the tank. The filter is positioned between the inlet and the reservoir to retain particulate within the fluid. The weir defines a weir edge. The weir edge is parallel to and substantially below the level of the tank fluid surface to allow particulate in the fluid to pass under the weir when the reservoir pump is activated and to prevent particulate in the fluid from passing under the weir when the reservoir pump is deactivated. The filter may be serviced through an access opening formed in a fabricated surface above the filter covered by a cover.

16 Claims, 3 Drawing Sheets

POOL SKIMMER

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates generally to circulation systems which cause fluid to flow through various system components for the purposes of clarifying, heating, purifying and returning the fluid back to the original body of fluid, and more particularly, to pool skimmer system which cause water to flow through a basket to remove debris floating on the surface of a pool and to return the water back to the pool.

In the context of swimming pools, the water in the pool is filtered through a circulation system. In particular, the circulation system has a reservoir attached adjacent to the pool. The reservoir and the pool are attached to each other through an inlet. Water is filled into the pool to a level above the inlet such that the water from the pool passes through the inlet into the reservoir. In this regard, the inlet is partially submerged under the surface of the water in the pool, and the level of the water in the pool is equal to the level of the water in the reservoir. The reservoir is connected to a pump which draws water from the pool side of the inlet to the reservoir side of the inlet. The reservoir additionally has a filter which traps any debris floating on the surface of the water and in the water. When the circulation system is deactivated, the debris trapped in the filter is trapped in the reservoir by a rotatable weir. The weir is located at the inlet. The weir only rotates toward the reservoir. In this regard, the weir is capable of preventing passage of water from the reservoir to the pool. The weir allows passage of water from the pool to the reservoir but not from the reservoir to the pool.

The filter discussed above requires regular cleaning. In this regard, an access opening is provided directly above the filter. The access opening is formed in a deck which surrounds the pool. Multiple techniques are employed in the prior art to cover the access opening. An example of a cover is disclosed in U.S. Pat. No. 6,393,771 ('771 patent') which is expressly incorporated herein by reference. Briefly, the '771 patent discloses a cover comprising a frame and a cap member. The deck is modified with an opening sized and configured to receive the frame, and the cap member is sized and configured in conjunction with the frame to be removeably engagable therefrom.

In the context of swimming pools, the above described circulation system is typical of circulation systems in current use. To trap debris floating on the surface of the pool water, the circulation system requires that the pump be extraordinarily powerful such that debris floating on the pool water are drawn toward and passes through the inlet. Additionally, debris is drawn toward but does not pass through the inlet. Instead, the debris floating on the water of the pool collects on both sides of the inlet. The present invention alleviates the deficiencies in the prior art.

BRIEF SUMMARY OF THE INVENTION

In accordance with the present invention, there is provided a skimmer system attached to a tank having fluid therein. The fluid in the tank defines a tank fluid surface, the system comprises a reservoir, an inlet, a reservoir pump and a weir. In particular, the reservoir receives fluid from the tank. The fluid in the reservoir defines a reservoir fluid surface. The level of the reservoir fluid surface is maintained below the level of the tank fluid surface when the skimmer system is turned on. The inlet defines an inlet edge and an inlet surface. The inlet edge is located below the level of the tank fluid surface. The inlet surface declines away from the tank to transfer the fluid from the tank to the reservoir. The reservoir pump transfers fluid from the reservoir to the tank. The filter is positioned between the inlet and the reservoir to retain particulate within the fluid. The weir defines a weir edge. The weir edge is parallel to and substantially below the level of the tank fluid surface to allow particulate in the fluid to pass under the weir when the reservoir pump is activated and to prevent particulate in the fluid from passing under the weir when the reservoir pump is deactivated.

The inlet edge may be set to be about one inch below the level of the tank fluid surface. An opening of the inlet is defined by the inlet edge and a height. The inlet edge may be 24 inches. The height may be four inches. The inlet surface may have a decline of about 20 degrees.

A fluid transfer rate of the inlet may be equal to the fluid transfer rate of the reservoir pump. Alternatively, a fluid level regulator which monitors the level of the reservoir fluid surface and controls the reservoir pump to maintain the level of the reservoir fluid surface below the level of the tank fluid surface is attached to the reservoir, and a fluid transfer rate of the reservoir pump is greater than a fluid transfer rate of the inlet. The fluid level regulator activates the reservoir pump when the level of the reservoir fluid surface is not substantially below the level of the tank fluid surface. The reservoir pump may be activated for a set period of time to drain the reservoir, or the fluid level regulator de-activates the reservoir pump when the fluid level regulator is in the down position.

The skimmer system may further comprise a conical tray with an aperture at the center thereof. The tray may be positioned above the reservoir. The aperture may be sized and configured to receive and secure the filter. The tray is located under the inlet surface so as to receive the fluid transferring through the inlet.

The reservoir may have a tubular or a cylindrical configuration. The reservoir may have a capacity of about 12 to 16 cubic feet. In relation to the cylindrical configuration, the reservoir may have a diameter of about 30 inches. In relation to the tubular configuration, the reservoir may have a base dimension of thirty inches by thirty inches.

The skimmer system may further comprise an overflow valve attached to the reservoir one inch above the inlet edge.

The skimmer system may further comprise a cover for closing a utility access opening formed in a fabricated surface surrounding the tank and positioned above the filter. The access opening extends through the fabricated surface having an exposed appearance. The cover comprises a cap member engagable within the opening. The cap member has a cross sectional cavity adapted to receive a selected material. The cap member further having at least one hand engagable grip for lifting the cap member and the material placed in the cavity of the cap member from the opening. The cap member with the material disposed within the cavity thereof provides an exposed surface having an appearance substantially identical to the exposed appearance of the fabricated surface.

In another embodiment of the present invention, a cover for closing a utility access opening is provided. The access opening extends through a fabricated surface having an exposed appearance. The cover comprises a cap member. The cap member is engagable within the opening. The cap member may have a cross sectional cavity adapted to receive a selected material. The cap member may further have at least one hand engagable grip for lifting the cap member and the material placed in the cavity of the cap member from the opening. The hand engagable grip may be positioned at a periphery of the cap member. The cap member with the material disposed within the cavity thereof provides an exposed surface having an appearance substantially identical to the exposed appearance of the fabricated surface.

The cover may have two hand engagable grips which are a pair of hollow tubes for creating respective holes extending through the cap member and the materials placed in the cavity of the cap member. The tubes are sized for receiving human fingers and have a flared cross section for gripping the tube with human fingers. The two hand engagable grips are formed opposite each other and aligned with a center of gravity of the cap member and the selected material placed in the cavity of the cap member.

The cap member may have a bottom plate, a lateral wall, and a plurality of support posts disposed within cavity of the cap member wherein each post is attached to both the bottom plate and the lateral wall.

The selected material may be castable. The cap member may additionally have at least one hole for draining moisture from the material placed within the cavity of the cap member.

In another embodiment of the present invention, an access assembly for constructing a covered access opening is provided. The access opening extends through a fabricated surface having an exposed appearance. The assembly comprises a frame and a cap member. The frame has an opening for lining a wall surface of an access passage through the fabricated surface. The cap member is engageable within the opening of the frame. The cap member has a cross sectional cavity adapted to receive a selected material. The cap member may further have at least one hand engageable grip for lifting the cap member and the material placed in the cavity of the cap member from the opening. The hand engagable grip(s) is formed at a periphery of the cap member.

The cap member may have two hand engageable grips which are a pair of hollow tubes for creating respective holes extending through the cap member and the materials placed in the cavity of the cap member. The tubes are sized for receiving human fingers and have a flared cross section for gripping the tube with human fingers. The two hand engagable grips are formed opposite each other and aligned with a center of gravity of the cap member and the selected material placed in the cavity of the cap member.

The selected material may be castable. The cap member may additionally have at least one hole for draining moisture from the material placed within the cavity of the cap member. The cap member may have a bottom plate, a lateral wall, and a plurality of support posts disposed within the cavity of the cap member wherein each post is attached to both the bottom plate and the lateral wall. The cap member may have a selected material within the cavity and wherein the selected material has an appearance substantially identical to the exposed appearance of the fabricated surface. The cap member may have a selected material within the cavity and wherein the selected material has an appearance compatible with the exposed appearance of the fabricated surface.

The frame may have an interior rim for engaging the cap member.

DETAILED DESCRIPTION OF THE INVENTION

FIGS. 1–7 are for the purpose of illustrating the preferred embodiments of the present invention, and not for the purpose of limiting the present invention. The following discussion of the preferred embodiments of the present invention will describe the preferred embodiments in the context of residential and commercial pools. The present invention is not limited to residential and commercial pools. Rather, they may be expanded into other uses. For example, the preferred embodiment of the present invention may be applicable to water, oil or other fluidic tanks.

Figure 1:
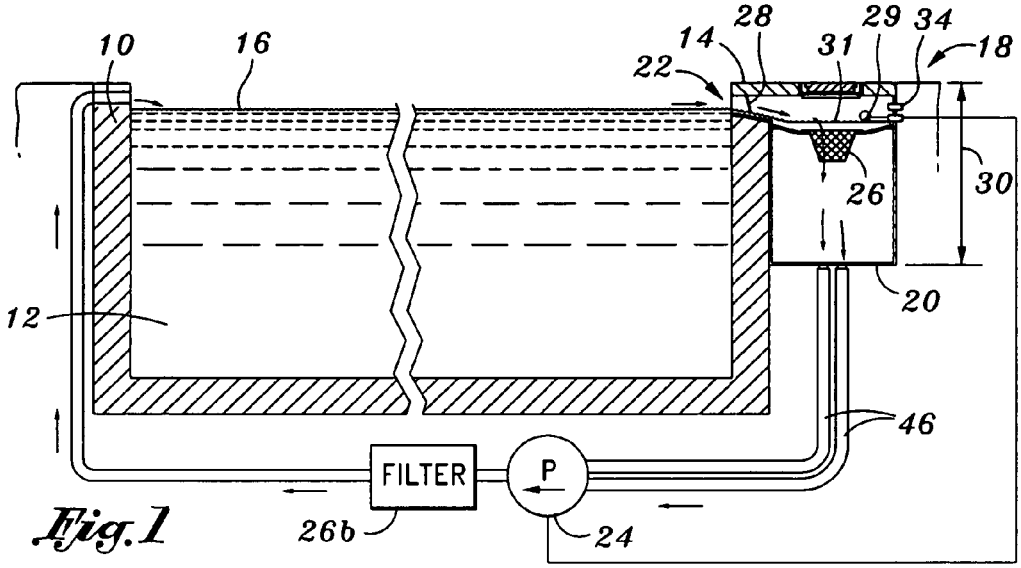
FIG. 1 illustrates a front elevational view of a skimmer system attached to a tank and a cover.

The residential or commercial pool may be a permanently installed pool, in-ground pool, above-ground-pool or an on-ground pool. For purposes of this discussion, the pool which contains the body of water shall be referred to as the tank 10, and the water within the pool shall be referred to as the fluid 12, as shown in FIG. 1. The area beside the tank 10 is the fabricated surface 14. The fluid 12 when filled into the tank 10 defines a tank fluid surface 16. The level of the tank fluid surface 16 changes over time due to evaporation or user intervention. Typically, the tank 10 will have an open top. The tank has an inlet fluid valve (not shown) which may be turned on automatically through a remote controller or manually through user intervention. The inlet fluid valve fills the tank 10 with fluid from an outside source to raise the level of the tank fluid surface 16. The rate at which the fluid 12 is filled into the tank 10 defines a fluid transfer rate of the inlet fluid valve. The fluid transfer rate is the amount of fluid 12 that is transferred between two points per a unit of time. For example, the fluid transfer rate of the inlet fluid valve is the amount of fluid 12 that may be transferred from the outside source into the tank 10 per a unit measurement of time.

FIG. 1 illustrates the skimmer system 18. The skimmer system 18 comprises a reservoir 20, inlet 22, reservoir pump 24, filter 26, weir 28 and a fluid level regulator 29. The skimmer system 18 may be incorporated into the circulation system of the tank 10.

The reservoir 20 is generally located adjacent to the tank 10, and is generally located below the level of the tank fluid surface 16 when the tank 10 is full. When the reservoir 20 is filled with fluid, the fluid defines a reservoir fluid surface 31. The reservoir 20 generally has a capacity to hold approximately 12 to 16 cubic feet of fluid 12. The tank 10 may have a cylindrical configuration or a tubular configuration. In relation to the cylindrical reservoir 20, the diameter of the cylindrical reservoir 20 may be approximately 30 inches, and the height 30 of the cylindrical reservoir 20 may be approximately 34 inches measured from the bottom of the reservoir 20 to the top of the fabricated surface 14. In relation to the tubular reservoir, the base of the reservoir 20 may have a dimension of about 30 inches by 30 inches, and the height 30 of the tubular reservoir may be about 34 inches measured from the bottom of the reservoir to the top of the fabricated surface 14.

Figure 2:
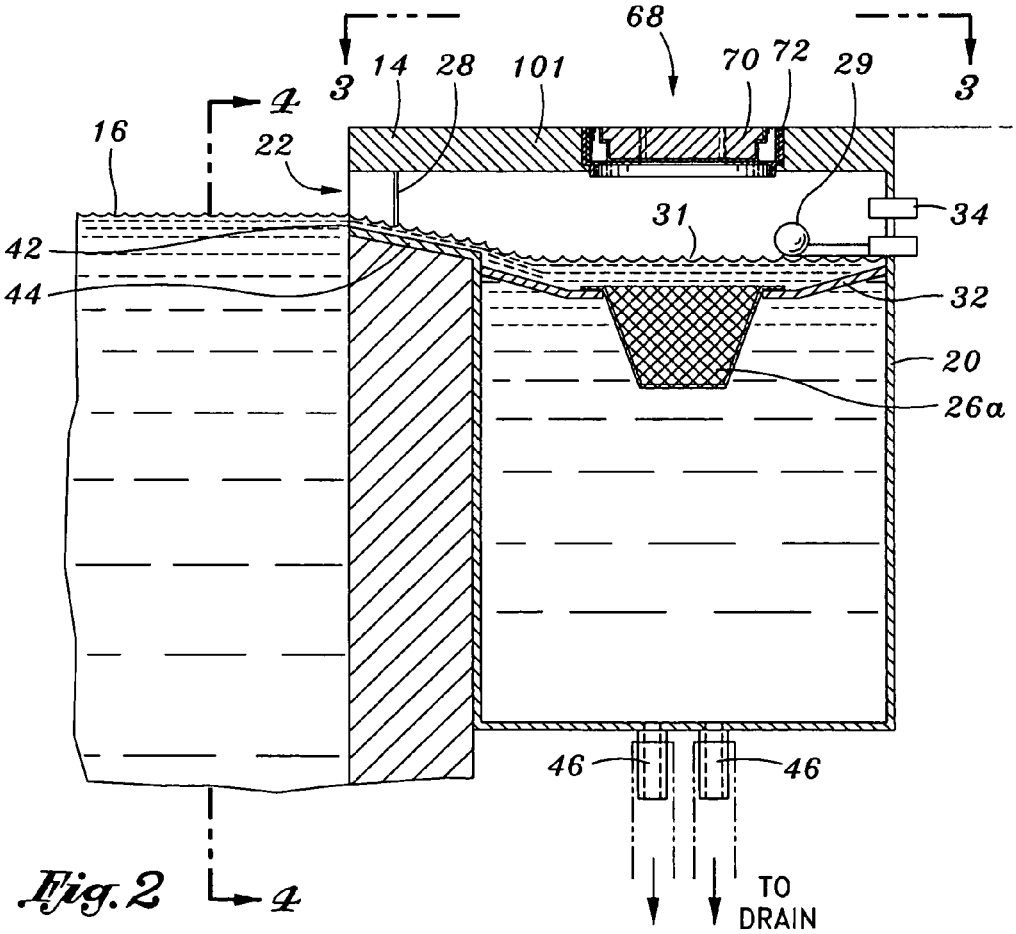
FIG. 2 is a cross sectional view of the skimmer system illustrated in FIG. 1.

Referring to FIG. 2, at the upper portion of the reservoir 20, there is a tray 32. The tray 32 may have an inverted conical configuration. The center of the tray 32 may have an aperture.

The filter 26 may be attached to tray 32. In particular, the filter 26 may be attached to the tray 32 at the aperture. In this regard, the aperture of the tray 32 is sized and configured to receive and secure the filter 26. The filter 26 may be a standard pool basket, a wire mesh filter, a permanent medium filter, diatomaceous earth filter, cartridge filter or vacuum filter. For example, as shown in FIG. 2, the filter 26*a* is a standard pool basket.

The fluid level regulator 29 may be attached to reservoir 20 to regulate the level of the reservoir fluid surface 31 by activating and deactivating the reservoir pump 24 (see FIG. 1). The fluid level regulator 29 monitors and regulates the level of the reservoir fluid surface 31 to be sufficiently below the level of the tank fluid surface 16. For example, the fluid level regulator 29 regulates the level of the reservoir fluid surface 31 to be about three inches below the level of the tank fluid surface 16. The fluid level regulator 29 may be a ballcock such as a float-arm ball type or a float-cup type. The ballcock has an up position and a down position. The up position indicates that the level of the reservoir fluid surface 31 is not sufficiently below the level of the tank fluid surface 16, and the down position may indicate that the level of the reservoir fluid surface 31 is near the bottom of the reservoir 20.

An overflow valve 34 may be attached to the reservoir 20, as shown in FIGS. 1 and 2. The overflow valve 34 may have an opened and closed position wherein the fluid 12 exits the reservoir 20, or is retained within the reservoir 20, respectively. The overflow valve 34 may be a spigot which may be automatically or manually controlled between the opened and closed positions. The overflow valve 34 drains the fluid from the tank 10 and reservoir 20 when the levels of the tank and reservoir fluid surface 16, 31 are too high.

Figure 4:
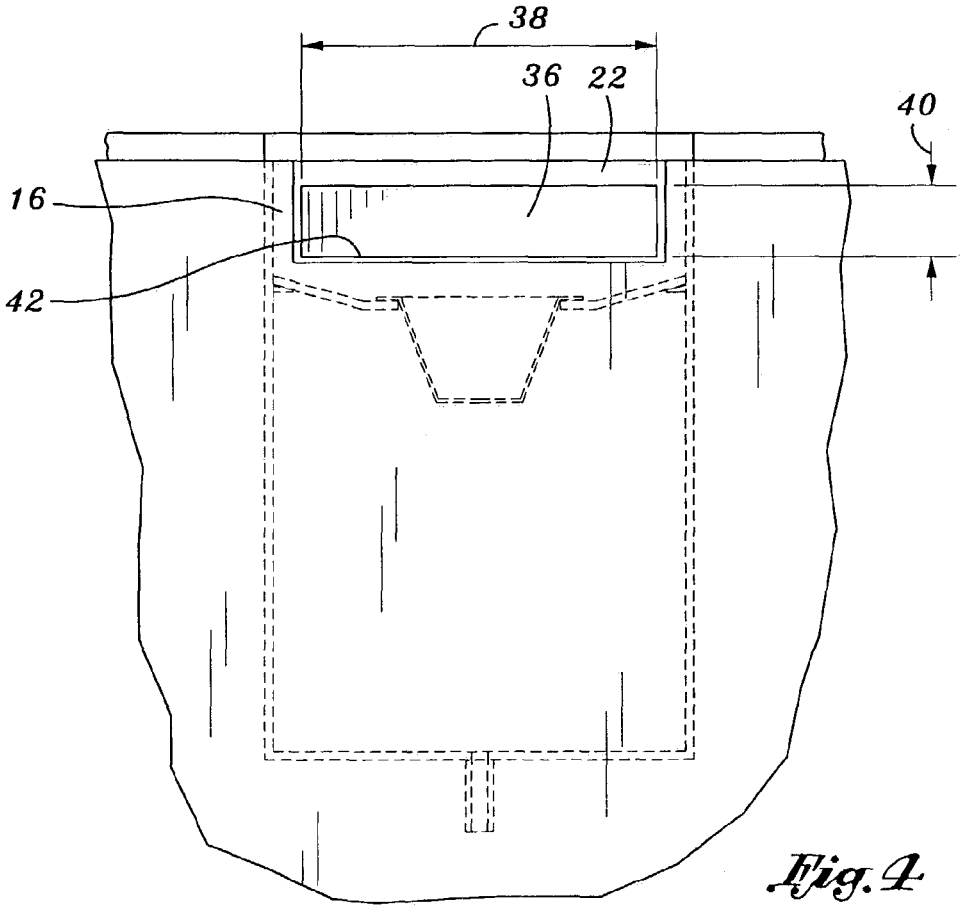
FIG. 4 is a side elevational view of an inlet illustrated in FIG. 2.

Referring to FIGS. 1, 2 and 4, an inlet 22 may be attached to the reservoir 20. As shown in FIG. 4, the inlet defines an opening 36. The opening 36 has a width 38 and a height 40. The inlet 22 further defines an edge 42. The width 38 of the edge 42 (i.e., the opening) may be about 24 inches. The height 40 of the opening may be about four inches. The inlet edge 42 is located approximately one inch below the level of the tank fluid surface 16. In other words, the inlet fluid valve is turned on until the level of the tank fluid surface 16 is approximately one inch above the inlet edge 42. Additionally, the overflow valve 34 may be positioned on and attached to the reservoir 20 at about one inch above the inlet edge 42.

Figure 3:
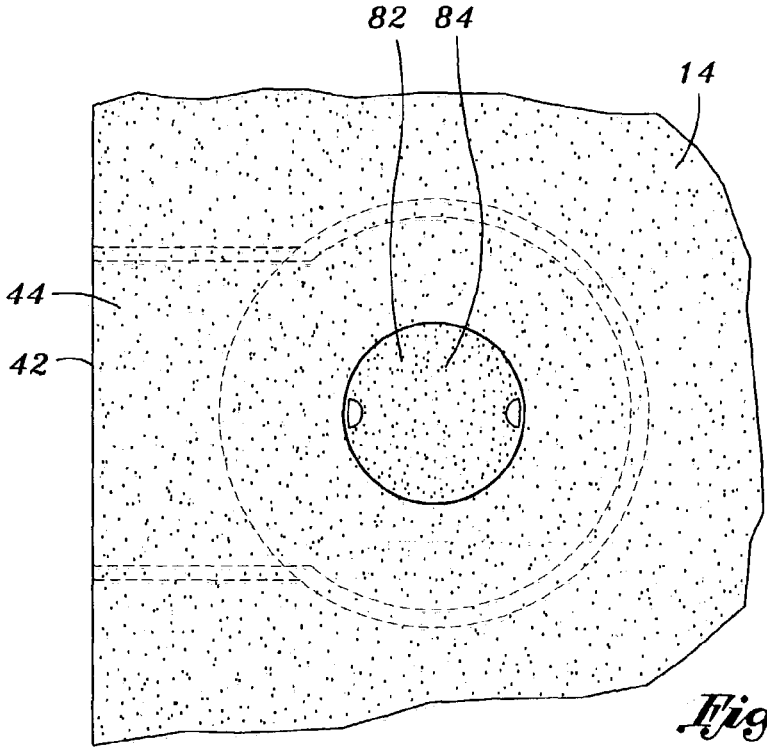
FIG. 3 is a top view of a fabricated surface as illustrated in FIG. 2.

The inlet edge 42 is connected to an inlet surface 44, as shown in FIGS. 2 and 3. The inlet surface 44 declines away from the inlet edge 42, as shown in FIG. 2. The rate of declination of the inlet surface 44 is about twenty degrees. For example, the horizontal component of the inlet surface 44 is about eight inches, and the vertical component of the inlet surface 44 is about three inches. The inlet 22 and the reservoir 20 are positioned relative to each other such that the inlet 22 directs the fluid 12 onto the tray 32 and eventually through the filter 26*a* and the reservoir 20. The tray 32 is located below and adjacent to the inlet surface 44. When the fluid 12 fills the tank 10 above the inlet edge 42, the fluid 12 is drawn into the inlet 22 due to pressure on the tank side and gravity on the reservoir side. The rate at which the fluid 12 is drawn into the inlet 22 defines the fluid transfer rate of the inlet 22. The fluid transfer rate of the inlet 22 is a function of the distance at which the inlet edge 42 is located below the tank fluid surface 16, the width 38 of the inlet edge 42, and the viscosity of the fluid 12. The fluid 12 in the tank 10 is considered to be the influent side of the inlet 22, and the fluid 12 in the reservoir 20 is considered to be the effluent side of the inlet 22.

The weir 28 is located above the inlet surface 44, as shown in FIG. 2. The weir 28 may be a square plate which extends across the whole width 38 (see FIG. 4) of the inlet opening 36. The weir 28 may be attached to the fabricated surface 14 and extend downward toward the inlet surface 44. The weir 28 extends substantially below the level of the tank fluid surface 16. The weir 28 extends toward but does not touch the inlet surface 44 so as to allow particulates within the fluid 12 and on the tank fluid surface 16 to pass under the weir 28 when fluid 12 is being transferred from the tank 10 to the reservoir 20. In the context of pools, the particulates may be leaves and dead insects. The particulates pass under the weir 28 because of the force of the fluid 12 being transferred from the tank 10 to the reservoir 20. The weir 28 may be fixedly attached to the fabricated surface 14. Alternatively, the weir 28 may be rotatably attached to the fabricated surface 14. In particular, the weir 28 may rotate only toward the reservoir 20. The normal position of the weir 28 may be vertical, as shown in FIG. 2. As discussed above, the fluid level regulator 29 monitors and regulates the level of the reservoir fluid surface 31 to be sufficiently below the level of the tank fluid surface 16. In this regard, the level of the reservoir fluid surface 31 is sufficiently below the level of the tank fluid surface 16 as long as the fluid 12 in the tank 10 and the particulates in the fluid 12 are able to pass through the inlet opening 36 and under the weir 28.

Attached to the bottom of the reservoir 20 are at least one and preferably two tubes 46 which drain the reservoir 20 of fluid 12, as shown in FIGS. 1 and 2. Each tube 46 may have a two inch diameter. The tubes 46 are subsequently attached to the reservoir pump 24 (see FIG. 1). When the reservoir pump 24 is active, the reservoir pump 24 actively transfers fluid 12 from the reservoir 20 to the tank 10. The reservoir pump 24 defines a fluid transfer rate which defines the rate at which the fluid 12 is transferred from the reservoir 20 to the tank 10. In this regard, the fluid 12 in the tank 10 is considered to be the effluent side of the reservoir pump 24, and the fluid 12 in the reservoir 20 is considered to be the influent side of the reservoir pump 24. The reservoir pump 24 is subsequently connected to a filter 26*b* (see FIG. 1). The filter 26*b* is subsequently connected to the tank 10.

The fluid transfer rate of the reservoir pump 24 may be constant or variable. In the context of pools, the fluid transfer rate of the reservoir pump 24 and the capacity of the reservoir 20 to contain fluid 12 are sized in relation to each other such that the reservoir pump 24 does not pump air. In this regard, the down position of the fluid level regulator 29 indicates that the level of the reservoir fluid surface 31 is within its safety factor to prevent the reservoir 20 from pumping air.

In relation to reservoir pumps 24 having a constant fluid transfer rate, the fluid transfer rate of the reservoir pump 24 may he greater than the fluid transfer rate of the inlet 22. Alternatively, the fluid transfer rate of the reservoir pump 24 may be equal to the fluid transfer rate of the inlet 22. When the reservoir pump 24 is activated, then the level of the tank fluid surface 16 will rise which causes the fluid transfer rate of the inlet 22 to rise. In this regard, the reservoir pump 24 is sized such that the fluid transfer rate of the inlet 22 is equal to the fluid transfer rate of the reservoir pump 24 when the level of the tank fluid surface 16 is sufficiently below the level of the tank fluid surface 31. In this regard, the down position of the fluid level regulator 29 indicates that the level of the reservoir fluid surface 31 is sufficiently below the level of the tank fluid surface 16.

In relation to reservoir pumps 24 having variable fluid transfer rates, the fluid level regulator 29 varies the fluid transfer rate of the reservoir pump 24 as a function of the level of the reservoir fluid surface 31. The fluid level regulator 29 varies the fluid transfer rate of the reservoir pump 24 such that the level of the reservoir fluid surface 31 is sufficiently below the level of the tank fluid surface. For example, the fluid level regulator 29 varies the fluid transfer rate of the reservoir pump 24 such that the level of the reservoir fluid surface 31 is about three inches below the level of the tank fluid surface 16. Furthermore, the down position of the fluid level regulator 29 indicates that the level of the reservoir fluid surface 31 is sufficiently below the level of the tank fluid surface 16.

A general operation of the above described components will be discussed. When the tank 10 is empty, the inlet fluid valve is activated such that fluid 12 may fill the tank 10. The inlet fluid valve is maintained in the open position such that the fluid 12 fills the tank 10 till the level of the tank fluid surface 16 is about one inch above the inlet edge 42. At this time, the level of the tank fluid surface 16 is equal to the level of the reservoir fluid surface 31.

The skimmer system 18 is activated. The fluid level regulator 29 monitors that the level of the reservoir fluid surface 31 is not sufficiently below the level of the tank fluid surface and activates the reservoir pump 24 to drain the reservoir 20. The level of the reservoir fluid surface 31 is being reduced and the level of the tank fluid surface is increased while the reservoir pump 24 is active because the inlet 22 transfers fluid 12 from the tank 10 to the reservoir 20. This general description of the operation of the skimmer system 18 relates to reservoir pumps 24 having a fluid transfer rate greater than a fluid transfer rate of the inlet 22. In this regard, if the reservoir pump 24 is maintained in the active state and the fluid transfer rate of the inlet 22 is less than the fluid transfer rate of the reservoir pump 24, then the reservoir pump 24 will transfer all of the fluid 12 from the reservoir 20 to the tank 10 creating a dry pump situation. The fluid level regulator 29 deactivates the reservoir pump 24 when the fluid level regulator 29 reaches the down position to prevent the dry pump situation. The fluid level regulator 29 does not deactivate the reservoir pump 24 until the down position has been reached even though the level of the reservoir fluid surface 31 is more than sufficiently below the level of the tank fluid surface 16.

When the fluid level regulator 29 is in the down position, the reservoir pump 24 will be deactivated. Now, the fluid transfer rate of the inlet 22 is greater than the fluid transfer rate of the deactivated reservoir pump 24 thereby filling the reservoir 20 with fluid 12. The reservoir pump 24 will be maintained in the deactivated state until the fluid level regulator 29 indicates that the level of the reservoir fluid surface 31 is not sufficiently below the level of the tank fluid surface 16.

When the skimmer system 18 is activated, the reservoir pump 24 will cycle between the active and deactivated state based on the level of the reservoir fluid surface 31. Additionally, particulates which float on the tank fluid surface 16 (i.e., particulates which have a lower density than the fluid) are drawn into the inlet 22 and trapped by the filter **26*a*. Additionally, particulates which float within the fluid 12 (i.e., particulates which have about the same density as the fluid) in the tank 10 are drawn into the inlet 22 and trapped by the filter 26*a*. Additionally, other fluid treatment components may be added to the skimmer system 18** such as a clarifier, heater and purifier.

When the skimmer system 18 is deactivated, the inlet 22 continues to draw fluid 12 from the tank 10 to the reservoir 20 until the levels of the tank fluid surface 16 and reservoir fluid surface 31 are equal. At this point, the particulates which have a lower density than the fluid 12 may not pass under the weir 28 from the reservoir 20 to the tank 10 because the weir extends from the fabricated surface to below the level of the tank fluid surface. In this regard, the weir 28 extends substantially below the level of the tank fluid surface 16 as long as the particulates having a lower density than the fluid 12 cannot be transferred from the reservoir 20 to the tank 10 when the skimmer system 18 is deactivated.

One tank 10 may have multiple skimmer systems 18 attached thereto. For example, a plurality of skimmer systems 18 may be located equidistant around the circumference of the tank 10. When multiple skimmer systems 18 are attached to one tank 10, then the tubes 46 used to drain each reservoir 20 may be interconnected to a single reservoir pump 24.

Figure 5:
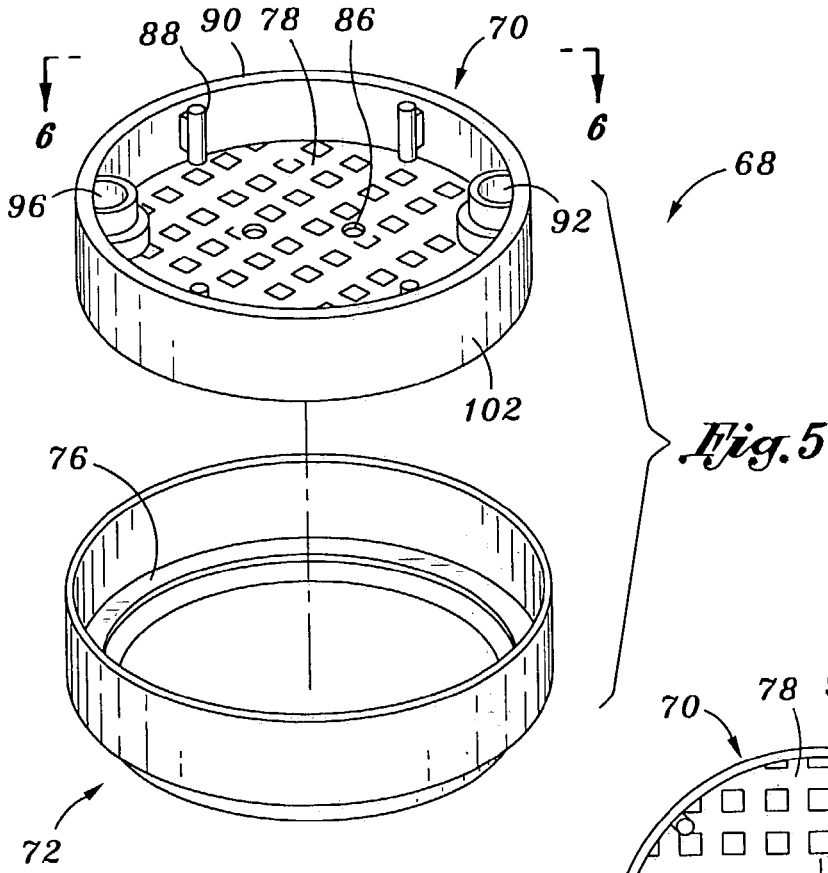
FIG. 5 is an exploded view of a cover.

The filter **26*a* needs to be cleaned out on a regular basis. As such, an access opening may be formed in the fabricated surface 14 above the filter 26*a*, as shown in FIGS. 1 and 2. The access opening may be formed directly above the filter 26*a* which is secured to the tray 32 of the reservoir 20. Referring to FIGS. 2 and 5, a cover 68 for closing the access opening is illustrated. The cover 68 includes a cap member 70 engageable within the access opening of the fabricated surface 14. The cover 68 is suitable for covering the access opening formed by the fabricated surface 14, however, the access opening is preferably formed with a frame 72 having an opening 74 disposed within the plane of the fabricated surface 14. To facilitate engagement of the cap member 70, the frame 72 can be provided with a rim 76 sized to engage a bottom plate 78 of the cap member 70. The cap member 70 and frame 72** can be constructed from any material having sufficient stiffness and durability, such as metal, fiberglass, plastic, ceramic, wood, etc.

Figure 6:
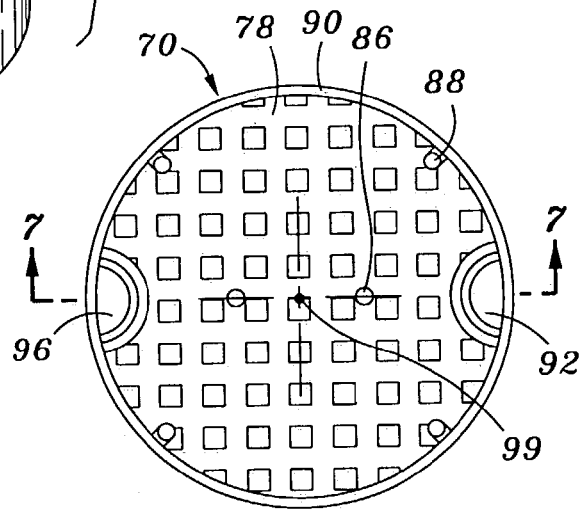
FIG. 6 is a top view of a cap member illustrated in FIG. 5.
Figure 7:
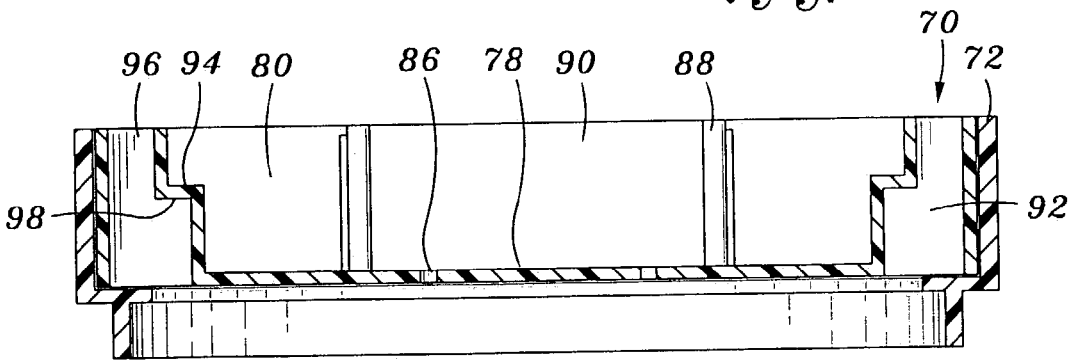
FIG. 7 is a front cross sectional view of the cover illustrated in FIG. 6.

As particularly shown in FIGS. 5–7, the cap member 70 has a substantially full cross sectional cavity 80 (see FIG. 7) for receiving a selected material 82 (see FIG. 3). The material 82 within the cavity 80 is selected to provide an exposed surface 84 having an appearance substantially identical with the exposed appearance of the fabricated surface 14, as shown in FIG. 3. Additionally, when the selected material 82 is identical to the material of the fabricated surface 14, the exposed surface 84 and fabricated surface 14 will have compatible functional properties as well, such as respective coefficients of friction and coefficients of expansion. While a homogenous material 82 is shown in FIG. 3, it is, of course, to be understood that non-homogenous materials such as stone and mortar or tile and grout can also be placed within the cavity 80 to provide an exposed surface 84 having a substantially identical appearance with a similarly non-homogenous fabricated surface. It is also to be understood, of course, that a person can select a material 82 to provide an exposed surface 84 with an appearance which is merely compatible with the appearance of the fabricated surface 14. For example, the user may prefer a material which completes a pattern in the overall landscape, or which creates a readily visible marker.

Referring again to FIGS. 5–7, the cap member 70 can be provided with a plurality of drain holes 86 for draining moisture from the material 82 placed within the cavity 80, and a plurality of support posts 88 attached to the bottom plate 78 and lateral wall 90 of the cap member 70 for stiffening the lateral wall 90 and anchoring the material 82 within the cavity 80. Although two drain holes 86 and four support posts 88 are shown in FIGS. 5 and 6, it is, of course, recognized that the cap member 70 can be provided with one or more drain holes 86 or support posts 88.

Referring to FIGS. 5–7, the cap member 70 can also be provided with hollow finger grip tubes 92 to form respective holes 96 extending through the material 82 and the bottom plate 78 when the material 82 is placed within the cavity 80. The tubes 92 preferably have a flared cross-section 94 (see FIG. 7) and a resulting grip surface 98 (see FIG. 7) to provide a finger hold for lifting the cap member 70 and material 82 from the access opening.

The cap member 70 may have at least one hollow finger grip tubes 92. Preferably, the cap member 70 may have two hollow finger grip tubes 92. Each hollow finger grip tube 92 is located at distal ends of the cap member 70 within the cavity 80. The hollow finger grip tubes 92 are placed equidistantly from the center of gravity 99 (see FIG. 6) of the cap member 70 after being filled with the material 82. The hollow finger grip tubes 92 are aligned with the center of gravity of the cap member 70. In other words, a line connecting the two grip tubes 92 will cross substantially close to the center of gravity 99 of the cap member 70 filled with material 82. The line crosses substantially close to the center of gravity of the cap member 70 as long as the human hand, finger or other picking device may lift the cap member 70 from the access opening. The holes 96 may have a circular configuration or a semicircular configuration (see FIGS. 3 and 6). The semicircular configuration may have the same area but may allow more fingers to grip the hollow finger grip tubes compared to the circular configuration. The circular portions of the semicircularly configured holes 96 may be directed toward the center of gravity 99 of the cap member 70.

In use, the cap member 70 is placed within the frame 72 as shown in FIG. 2. Depending on the materials selected to construct the cover 68 and fabricated surface 14, it may be advantageous to wrap a self-adhering tape around the outer peripheral wall 102 (see FIG. 5) of the cap member 70 prior to inserting the cap member 70 in the frame 72. When so applied, the self-adhering tape prevents material from bonding to the cap member 70 and additionally minimizes the amount of excess material which may enter the gap between the frame 72 and cap member 70 as the cover and fabricated surface are constructed.

Once the cap member 70 is engaged within the frame 72, the assembly is placed within the intended plane for the fabricated surface as shown in FIG. 2. The assembly is then positioned and leveled so the cap member 70 will ultimately seat in a substantially level and flush position with the fabricated surface 14. To obtain a level and flush position with the fabricated surface, it may be necessary to countersink the frame 72 into the base 101 upon which the fabricated surface 14 will be constructed as illustrated in FIG. 2. The correct orientation for the frame 72 and cap member 70 can also be verified with a level placed across the cap member 70.

After the assembly is correctly positioned, the fabricated surface 14 is installed around the frame 72, and a material 82 is placed within the cavity 80 of the cap member 70. The exposed surface 84 of the material 82 typically must be smoothed and leveled so the cover 68 will seat in a level and flush position with the surrounding fabricated surface 14.

Once the material 82 has sufficiently stabilized within the cavity 80, the cover 68 is removed from the frame 72, the tape (if applied) is removed from the cap member 70, and any excess material is cleaned from the frame 72 and the cap member 70. The time required for stabilization will depend on the selected material 82, however, persons skilled in the art will recognize that the cover 68 typically should not be removed from the frame 72 until it is certain that the material 82 will remain in the cavity 80 of the cap member 70 and that the exposed surface 84 remain smoothed and level. The cap member 70 is then reinserted within the frame 72 for final placement until access is required.

In this manner, access is provided for critical utilities disposed underneath the cover 68 such as for cleaning the filter 26*a*. In addition, the cover 68 can be constructed from a material 82 which provides an exposed surface 84 having an appearance substantially identical with the fabricated surface 14. Moreover, the functional properties of the exposed surface 84 will also be compatible with those of the fabricated surface 14 if the cover 68 is constructed from the same material as the fabricated surface 14. Furthermore, the cover 68 is custom fabricated to better match with the great variety of different fabricated surfaces. Thus, while it is recognized that an illustrative and presently preferred embodiment of the invention has been described in detail herein, it is likewise to be understood that the inventive concepts may be otherwise embodied and employed and that the appended claims are intended to be construed to include such variations except insofar as limited by the prior art.

What is claimed is:

1. A skimmer system attached to a tank having fluid therein, the fluid in the tank defining a tank fluid surface, the system comprising:

a) a reservoir to receive fluid from the tank, the fluid in the reservoir defining a reservoir fluid surface, the level of the reservoir fluid surface being maintainable below the level of the tank fluid surface;

b) an inlet defining an inlet edge, an inlet surface and a fluid transfer rate, the inlet being positioned adjacent to the tank, the inlet edge being located below the level of the tank fluid surface, the inlet surface declining away from the tank, the inlet surface being positioned above the reservoir to transfer the fluid from the tank to the reservoir;

c) a reservoir pump connected to the reservoir to transfer fluid from the reservoir to the tank, the reservoir pump having a fluid transfer rate greater than the inlet fluid transfer rate;

d) a filter between the inlet and the reservoir to retain particulate within the fluid;

e) a weir defining a weir edge, the weir edge being substantially below the level of the tank fluid surface to allow particulate in the fluid to pass under the weir when the reservoir pump is activated and to prevent particulate on the fluid from passing under the weir when the reservoir pump is deactivated;

f) a fluid level regulator which monitors the reservoir fluid surface and controls the reservoir pump to maintain the level of the reservoir fluid surface sufficiently below the level of the tank fluid surface wherein the fluid level regulator activates the reservoir pump when the level of the reservoir fluid surface is not substantially below the level of the tank fluid surface.

2. The skimmer system of claim 1 wherein the reservoir pump is activated for a set period of time to drain the reservoir.

3. The skimmer system of claim 1 wherein fluid level regulator de-activates the reservoir pump when the fluid level regulator is in a down position.

4. The skimmer system of claim 1 wherein the inlet edge is about one inch below the level of the tank fluid surface.

5. The skimmer system of claim 4 wherein the inlet edge is about 24 inches wide and an inlet opening is about four inches high.

6. The skimmer system of claim 1 wherein the inlet surface has a decline of about 20 degrees.

7. The skimmer system of claim 1 further comprising a conical tray with an aperture at the center thereof being positioned above the reservoir, the aperture being sized and configured to receive and secure the filter, the conical tray located under the inlet so as to receive the fluid transferring through the inlet.

8. The skimmer system of claim 1 wherein the reservoir has capacity of about 12 to 16 cubic feet.

9. The skimmer system of claim 1 wherein the reservoir has a cylindrical configuration.

10. The skimmer system of claim 9 wherein the radius of the reservoir is thirty inches.

11. The skimmer system of claim 1 wherein the reservoir has a tubular configuration.

12. The skimmer system of claim 11 wherein the reservoir has a base dimension of thirty inches by thirty inches.

13. The skimmer system of claim 1 further comprising an overflow valve attached to the reservoir one inch above the inlet edge.

14. The skimmer system of claim 1 further comprising a cover for closing a utility access opening formed in a fabricated surface surrounding the tank and positioned above the filter, the access opening extending through the fabricated surface having an exposed appearance, the cover comprising a cap member engagable within the opening, the cap member having a cross sectional cavity adapted to receive a selected material, the cap member further having at least one hand engagable grip for lifting the cap member and the material placed in the cavity of the cap member from the opening, wherein the cap member with the material disposed within the cavity thereof provides an exposed surface having an appearance substantially identical to the exposed appearance of the fabricated surface.

15. The skimmer system of claim 1 wherein the level of the reservoir fluid surface is not substantially below the level of the tank fluid surface when the level of the reservoir fluid surface is less than about three inches below the level of the tank fluid surface.

16. The skimmer system of claim 1 wherein the fluid level regulator de-activates the reservoir pump when the level of the reservoir fluid surface is more than about three inches below the level of tank fluid surface.

* * * * *